United States Patent [19]

Foglio

[11] Patent Number: 4,953,760

[45] Date of Patent: Sep. 4, 1990

[54] SLIDE-GATE POURING APPLIANCE FOR LADLES AND SIMILAR DEVICES

[75] Inventor: Salvatore Foglio, Taranto, Italy

[73] Assignees: Nuova Sanac S.p.A.; ILVA S.p.A., both of Genoa, Italy

[21] Appl. No.: 363,857

[22] Filed: Jun. 9, 1989

[51] Int. Cl.[5] ..... B22D 41/40

[52] U.S. Cl. ..... 222/600

[58] Field of Search ..... 222/590, 597, 600, 591; 266/236

[56] References Cited

U.S. PATENT DOCUMENTS

| | | | |
|---|---|---|---|
| 3,765,579 | 10/1973 | Cramer et al. | 222/600 |
| 4,063,668 | 12/1977 | Shapland et al. | 222/600 |
| 4,424,958 | 1/1984 | Bachmann | 222/600 |
| 4,660,749 | 4/1987 | Yokoi et al. | 222/600 |
| 4,667,937 | 5/1987 | King | 222/600 |

*Primary Examiner*—S. Kastler

*Attorney, Agent, or Firm*—Fleit, Jacobson, Cohn, Price, Holman & Stern

[57] ABSTRACT

This invention refers to a slide-gate pouring appliance for ladles and similar devices. The slide-gate pouring appliance according to the invention is of the type having:

a first fixed metal frame, solid with the bottom of a ladle, to which a first holed refractory plate is secured, a second metal frame, removable and tilting, hanging with a clearance from said fixed frame and supporting by means of suitable guides:

a third metal frame (to which a second refractory plate, called the mobile plate, holed, is secured) capable of sliding between a first working position in which the holes in the fixed and mobile refractory plates are aligned and a second working position in which the holes in the fixed and mobile refractory plates are on different axes and do not coincide with one another.

This type of slide-gate pouring appliance necessarily has a locking device to press the two refractory plates, one fixed and one mobile, into contact with one another and hold them there.

In the slide-gate pouring appliance according to the invention, the locking device has on either side of said mobile frame, a container for springs jointed to the lower end of a pair of link rods which, at their upper ends, are jointed to said fixed frame.

These springs push a suitable prod against an outer flange of said removable frame and the axis of action of the spring is external to the straight line joining the centres of the articulating pins of said link rods.

15 Claims, 13 Drawing Sheets

FIG. 20
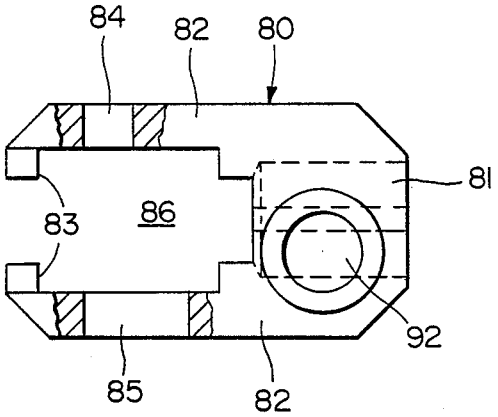
FIG. 21
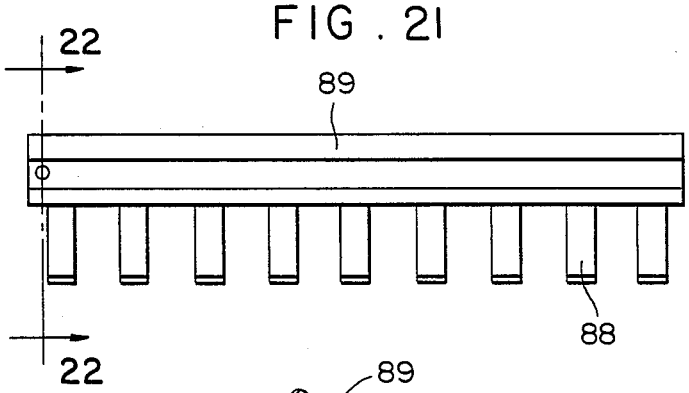
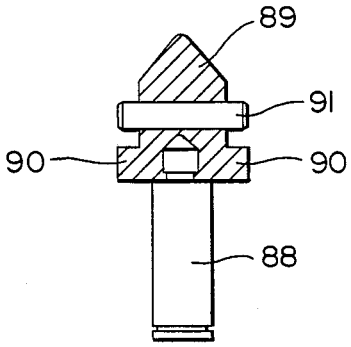
FIG. 22

SLIDE-GATE POURING APPLIANCE FOR LADLES AND SIMILAR DEVICES

BACKGROUND OF THE INVENTION

Slide-gate pouring appliances of the known type have a pair of holed plates made of refractory material, of which one fixed and one mobile, so that the relative movement of said plates allows the pouring appliance to be brought from a closed to an open position and vice versa.

In general the fixed holed plate is secured to the bottom of the ladle by means of a fixed metal frame.

In turn, the mobile holed plate is inserted in a metal frame which slides on a second metal frame, removable and tilting, which, in its working position, is pushed against the bottom of the ladle to as to keep the two opposite surfaces of the two fixed and mobile refractory plates in contact.

There are suitable sliding guides between the sliding frame, also known as the third frame, and the removable frame.

In order to enable the removable frame, also called the second frame, to push the sliding refractory plate in a controlled manner against the fixed refractory plate, it must be secured against the bottom of the ladle by some adjustable tightening means capable of accomplishing the following contrasting needs:

- ensuring sealing of the two refractory surfaces in contact with one another;
- allowing relative sliding during the slide-gate opening and closing movements.

In the oldest slide-gate pouring appliances the removable frame was secured by means of slots and bolts which were tightened one after another in several stages, until a sufficiently constant pressure on the boundaries of the removable frame was achieved.

This system called for relatively long adjustment tines, since the tightening torque of the whole series of fixing bolts had to be checked two or three times, using special torque wrenches.

More recently, the use of tightening means which are quicker to adjust has been introduced.

According to previous patents owned by the applicant, the removable frame was secured to the fixed frame with a clearance and subsequently the correct compression between the mobile plate and the fixed plate was achieved by suitable wedge-shaped means sliding longitudinally or along arcs of a circle.

According to another invention by the applicant, after having secured the removable frame against the fixed frame with a clearance, the required compression between the mobile and the fixed plates was achieved by means of torsion bars of a suitable length to allow recovery of the clearances and elastic application of a constant load all round the boundary of the removable frame by means of suitable squares protruding radially from these torsion bars.

These systems gave, and still give good results for medium-sized slide-gate pouring appliances.

Indeed the force or moment applied to said tightening means increases progressively and continuously and reaches its maximum value in the final stages of tightening.

Since the tightening operation, albeit with suitable means for amplifying the effort, must be made by hand, the operator must apply a gradually increasing load leading up to the maximum value required over a relatively long time (several seconds); this calls for a strong physical effort for large slide-gate pouring appliances.

The known state of the art envisages, furthermore, in addition to said torsion bars invented by the applicant, the use of spring-operated means to be dynamic compressed during the phase of tightening the fixed and mobile refractory plates between said upper fixed and lower removable frames.

The use of spring-operated means, however, does entail some difficulties due to the fact that the pressure must be evenly applied to the whole surface of contact between the fixed and mobile refractory plates, in any relative position.

A uniformly distributed pressure, moreover, requires a uniform state of compression of these spring-operated means and this is not easy to achieve due to the large number of springs involved.

An equal state of compression of the various springs calls for an equal distance between the shouldering surface of the springs themselves, which entails considerable difficulties considering that one of the linear dimensions on which said distance depends is the thickness of the refractory plates.

The problem is further complicated by the fact that the characteristics of the springs in question change considerably with temperature and therefore in order to achieve an evenly distributed pressure over the surfaces of contact of the refractory plates, the springs involved must be maintained at the same temperature or at very similar temperatures to one another.

In order to overcome this drawback, the known state of the art envisages, for example, the use of a ring of springs around the hole in the sliding refractory plate, so as to bring the springs near to the annular area of the plate in which sealing must absolutely be accomplished: on the other hand, the closeness of the springs allows if not a uniform temperature, at least a reciprocal cooperation of the various springs, since the areas of influence of these springs overlap one another. The disadvantage of this system is that the springs are applied basically against the back of the sliding refractory plate with high local specific pressures; this may lead to premature breaking of the sliding plate; in addition, these springs are located in the vicinity of the pouring hole, which entails high temperatures.

BRIEF SUMMARY OF THE INVENTION

According to this invention, once again the means for tightening the fixed plate against the mobile plate call for the compression of elastic means; however this compression is exerted by means of a dynamic action on lever-operated means, so that the effort on the part of the operator, however intense it may be, is limited in time: acting dynamically, the maximum intensity of the load applied can be greater, if it is applied only for a few fractions of a second.

It is therefore possible to make even very large slide-gate pouring appliances.

Furthermore, according to this invention the elastic means are mounted in two parallel rows on horizontally pivoted metal supports which act on the sides of the removable frame and moreover they are constrained to the fixed frame.

It is therefore possible to machine the bearing surfaces of the springs to a high degree of precision in order to obtain constant compression forces on all the springs.

In addition to this, since said elastic means are dislocated on the boundaries of the removable frame, relatively far away from the direct source of heat, that is to say the duct through which the liquid steel flows, their temperature is relatively low and can be kept constant for all the springs.

BRIEF DESCRIPTION OF THE DRAWINGS

FIG. 20 is a front view of one of the same detail, on plane view XX—XX of FIG. 19;

FIG. 21 is a side view of one of the two extended prods to be inserted in the container for the springs illustrated in the two preceding figures;

FIG. 22 is a cross-section of same, on plane XXII—XXII of the preceding figure;

DETAILED DESCRIPTION OF THE PREFERRED EMBODIMENT

Figure 1:
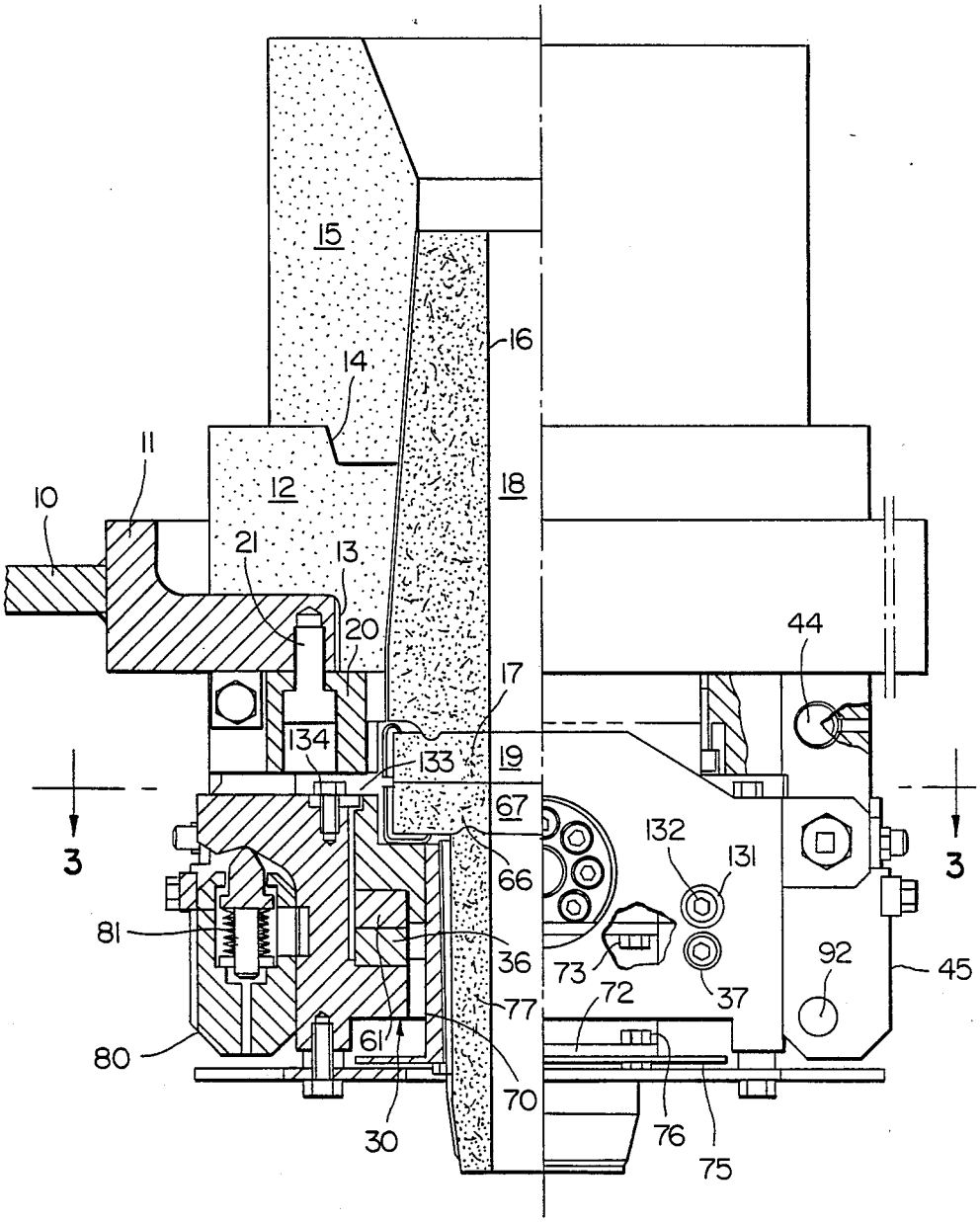
FIG. 1 is a front view, shown half as a cross-section, of a slide-gate pouring appliance according to the invention, in which the vertical plane of projection is perpendicular to the sliding direction of the mobile plate.

With specific reference to the above drawings, 10 is the bottom plating of a ladle fitted with an opening into which a flattening ring 11 is inserted and welded. In the central opening of said flattening ring an annular firebrick 12 is inserted from above, fitted with a centering spigot 13 and at the top with an undercut 14 for the lower spigot of a second annular refractory brick 15. The set of two firebricks 12 and 15 forms the so-called pouring appliance holder, surrounded by the refractory lining of the ladle not illustrated in the drawing. The pouring-appliance holder 12–15 has a truncated cone shaped hole flared downwards in which a refractory sleeve 16 is housed, indicated hereinafter as the fixed upper refractory sleeve, and it is also commonly called the "internal pouring appliance".

The fixed upper sleeve 16 rests on top of a fixed refractory plate 17, holed, supported by a fixed metal frame 20, fixed by screws 21 to the underside of the flattening ring 11.

The through holes for these screws 21 are indicated by 121.

The refractory sleeve 16 and the refractory plate 17 are equipped with aligned holes 18 and 19 through which the liquid metal passes.

Figure 4:
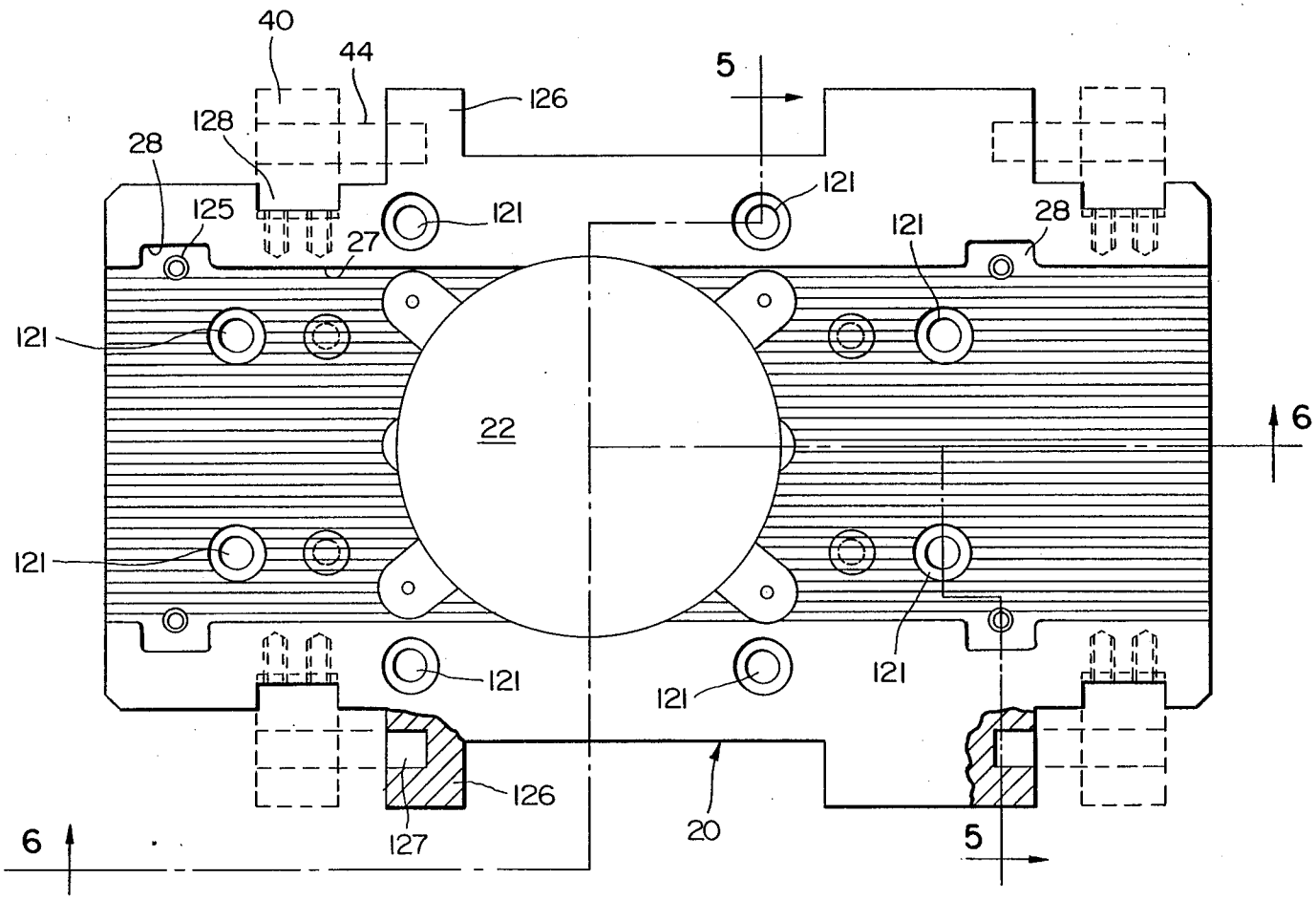
FIG. 4 is a view from below of the fixed frame, also called the first frame, fixed by its upper surface to the bottom of the ladle and which supports the first or fixed refractory plate.
Figure 6:
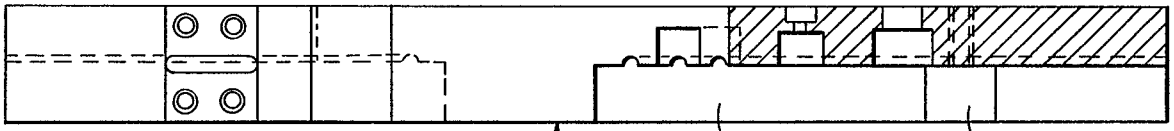
FIG. 6 is another cross-section of the fixed frame, on section plane VI—VI of FIG. 4.
Figure 5:
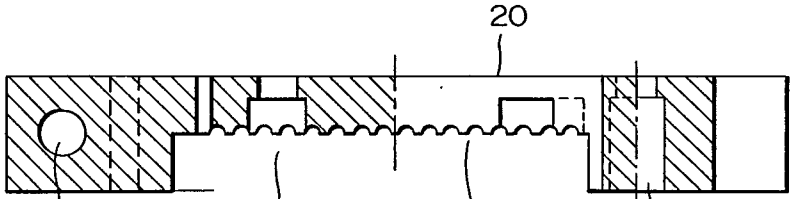
FIG. 5 is a cross-section of the fixed frame, on section plane V—V of FIG. 4.

The frame 20 has a wide circular opening 22 (see FIG. 4), through which the lower end of the sleeve 17 passes.

Inside the opening 22 in the fixed frame 20 there is a centering ring 23 equipped with radial lugs 24 suitable for securing by screws to special cavities 25 made in the inside surface of the fixed metal frame 20.

Figure 10:
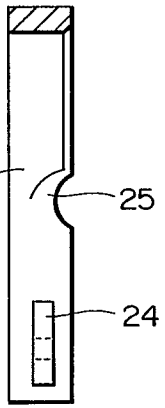
FIG. 10 is a side view, shown partly as a cross-section, of the same centering ring, on section plane X—X of the preceding figure.
Figure 9:
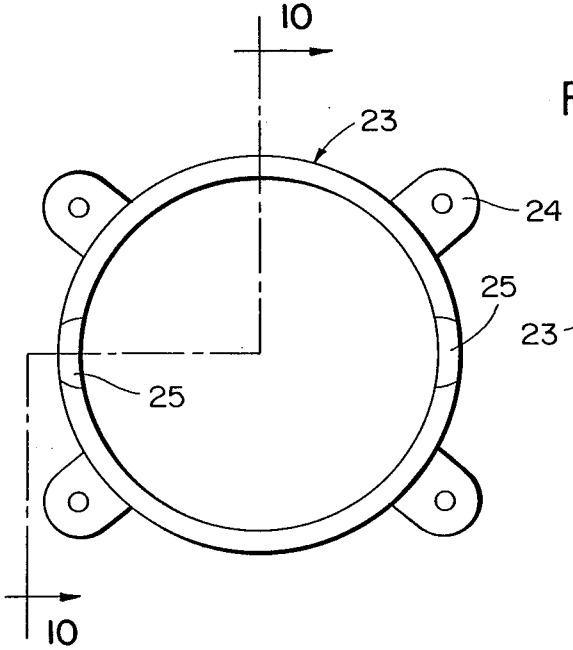
FIG. 9 is a plan view of a centering ring for a refractory sleeve to be fitted above the fixed refractory plate.

The purpose of said centering ring 23 (see FIGS. 1, 9 and 10) is to centre the lower end of the sleeve 16. It is equipped in two or more positions with flared indentations 25 which make it easier to insert a demolishing tool when the sleeve 16 has to be replaced due to wear. The fixed frame 20 has a wide longitudinal groove 26 with a ridged bottom, defined by longitudinal sides 27 within which the fixed refractory plate 17 is accommodated.

Figure 7:
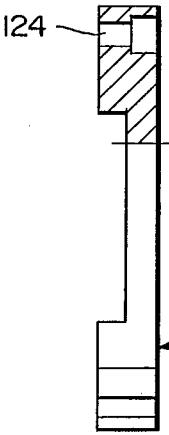
FIG. 7 is a front view of a bridge for retaining the end of the fixed plate.
Figure 8:
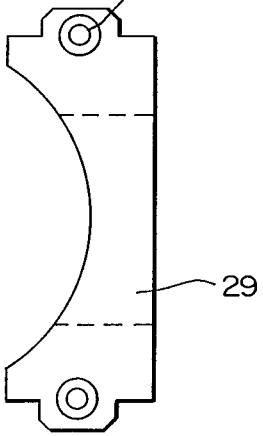
FIG. 8 is a plan view of the same item.

In these longitudinal sides 27 there are two pairs of recesses 28 capable of housing the ends of two bridges 29 for retaining the refractory plate 17 longitudinally (see FIGS. 7 and 8).

Figure 11:
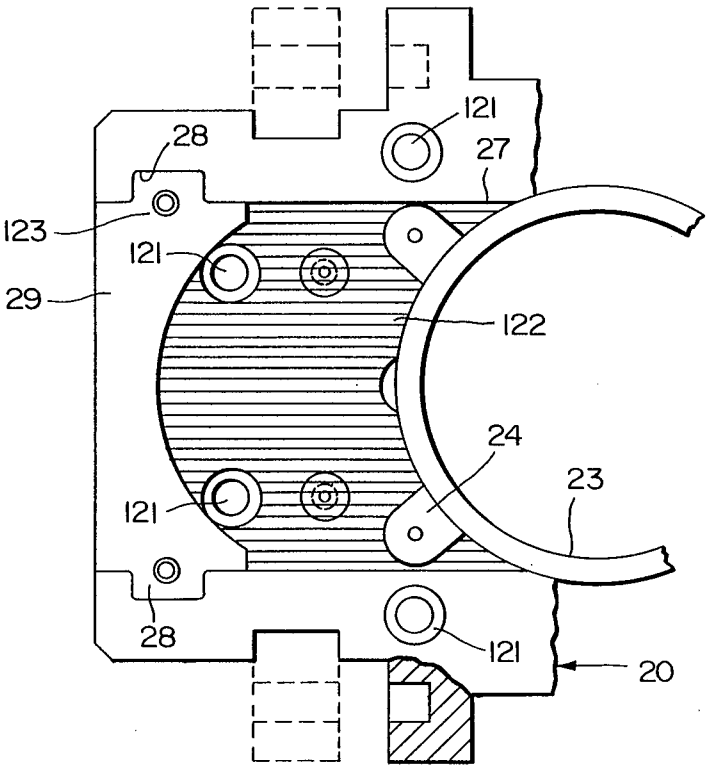
FIG. 11 shows part of the end of the fixed frame, seen from below, with the centering ring as per FIG. 9 and 10 and the retaining bridge as per FIGS. 7 and 8 applied to it.

FIG. 11 shows one of these bridges, secured to the fixed frame 20 by means of screws 123 which pass through holes 124 in the bridge and screw into threaded holes 125 in the frame 20; the same figure also shows the centering ring 23 in an assembled position.

The underside of the fixed metal frame 20 is equipped with longitudinal grooves 122 capable of accommodating mortar for fixing the fixed refractory plate 17.

Figure 12:
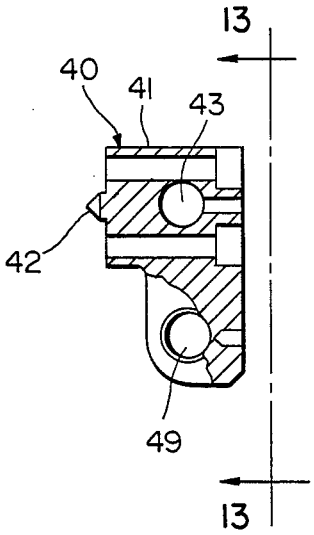
FIG. 12 shows, partly as a vertical cross-section, one of the four supporting brackets of the removable and tilting frame; these brackets protrude downwards from the fixed frame, to the sides of which they are secured by screws.
Figure 13:
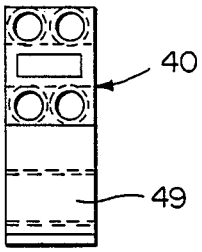
FIG. 13 is a front view of said bracket, on plane XIII—XIII of the preceding figure.
Figure 14:
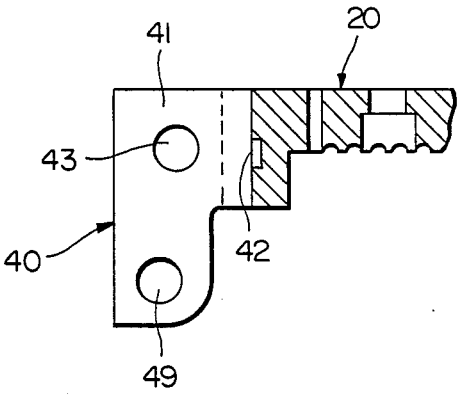
FIG. 14 is a partial cross-section of the fixed frame, similar to that illustrated in FIG. 5, after application of the bracket as per FIGS. 12 and 13.

On the longitudinal edges of the metal frame 20 there are two pairs of lugs 126 which protrude sideways and are passed through, at least partially, by holes 127. Next to these holed lugs 126, on the side edges of the fixed frame 20 there are recesses 128, into which the upper ends 41 of vertical brackets 40 fit partially (see FIGS. 12, 13 and 14), upper ends which protrude downwards in respect of the fixed metal frame 20.

The vertical brackets 40 are fitted with a centering spigot 42 which corresponds to the bottom of the recesses 128.

The vertical brackets 40 are secured to the fixed metal frame 20 by means of screws.

The vertical brackets 40 are also fitted with a pair of horizontal holes parallel to the longitudinal direction of the metal frame 20.

Figure 2:
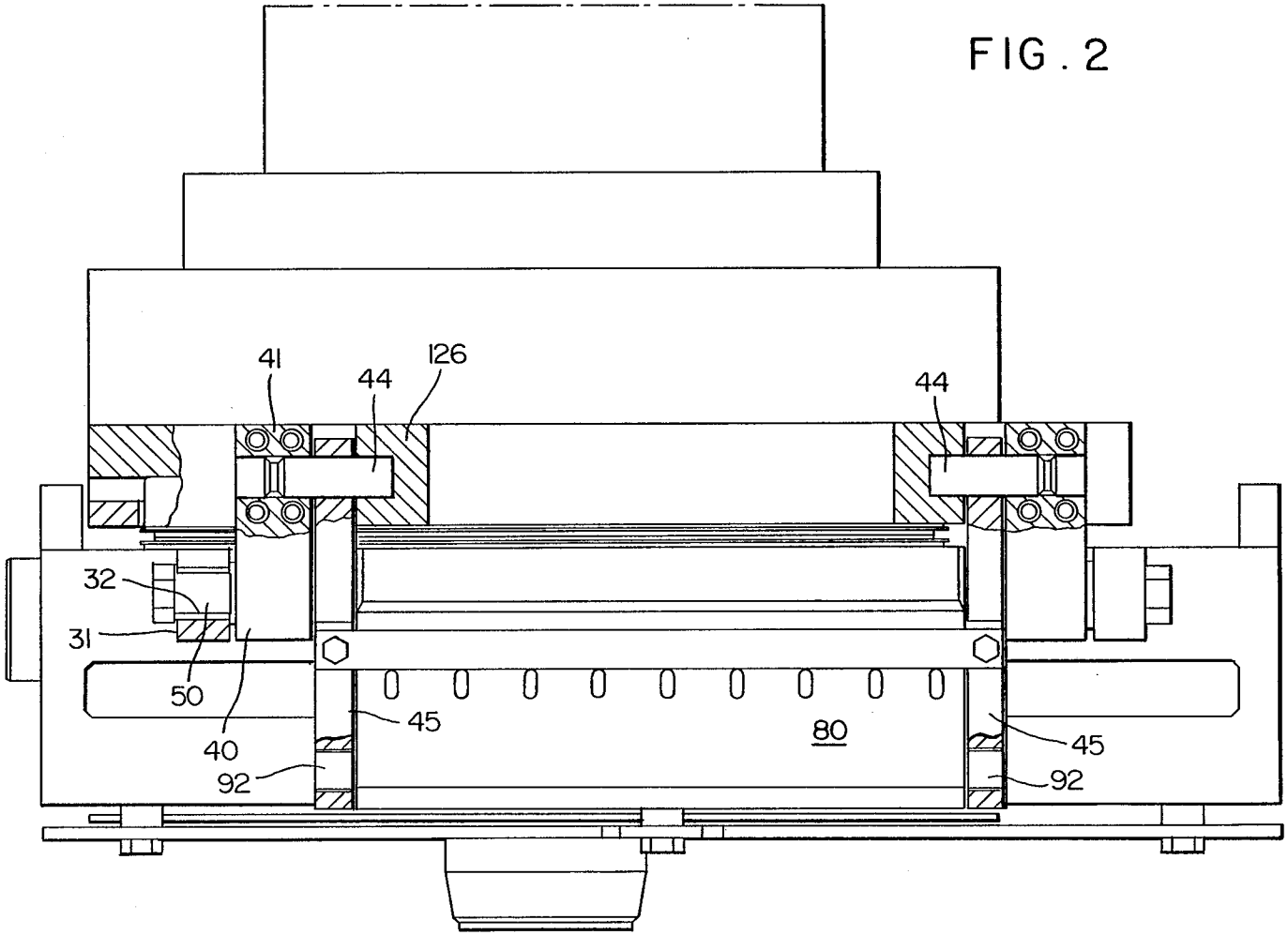
FIG. 2 shows a side view of the same appliance, with some parts as cross-sections.
Figure 3:
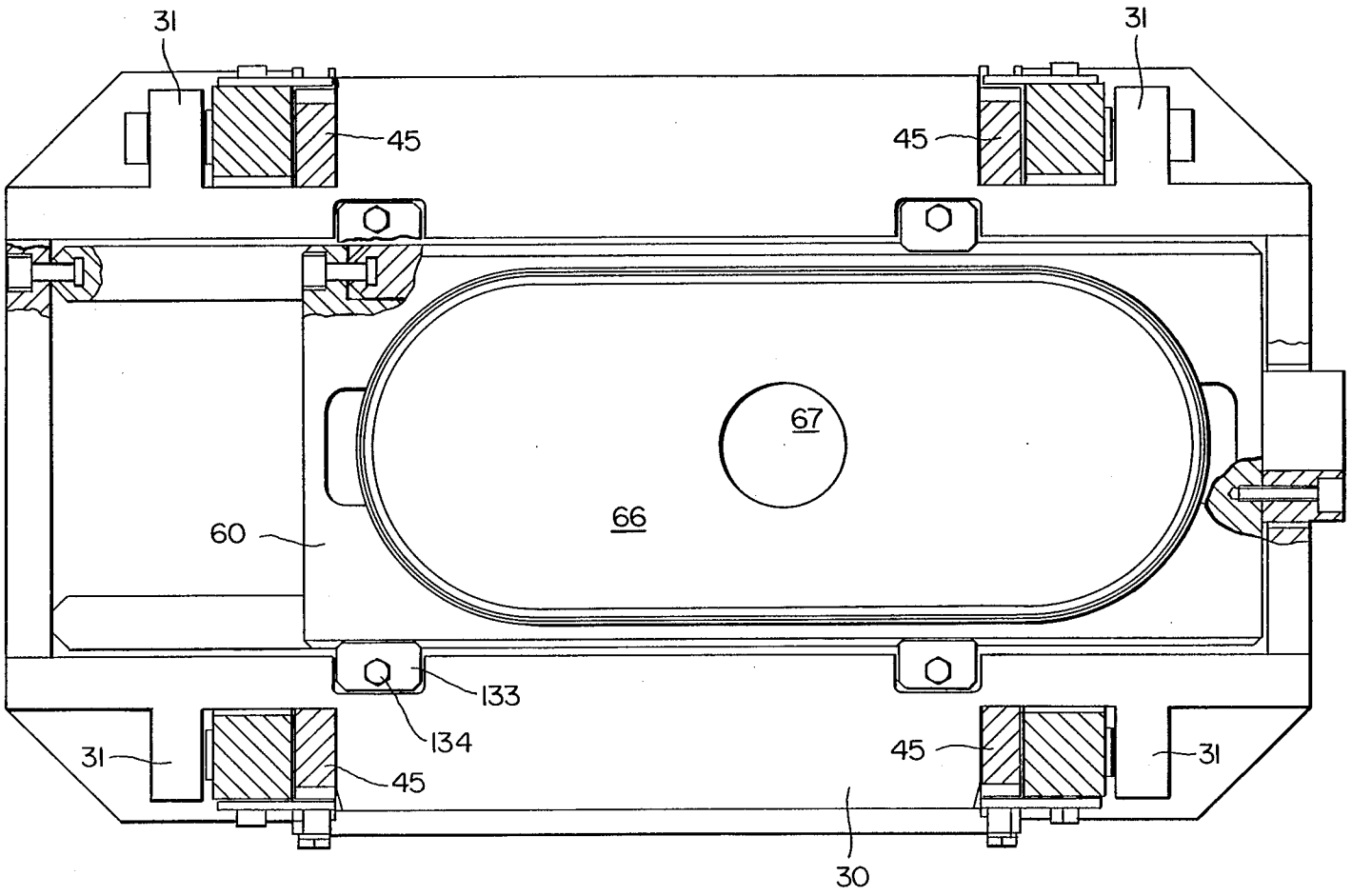
FIG. 3 is a view from above on the horizontal plane of section III—III of FIG. 1.

The first of these holes, the upper one, indicated by 43, is aligned with the hole 127 in the adjacent lug 126 and is capable of accommodating together with the latter a pin 44 (see FIG. 2).

Figure 18:
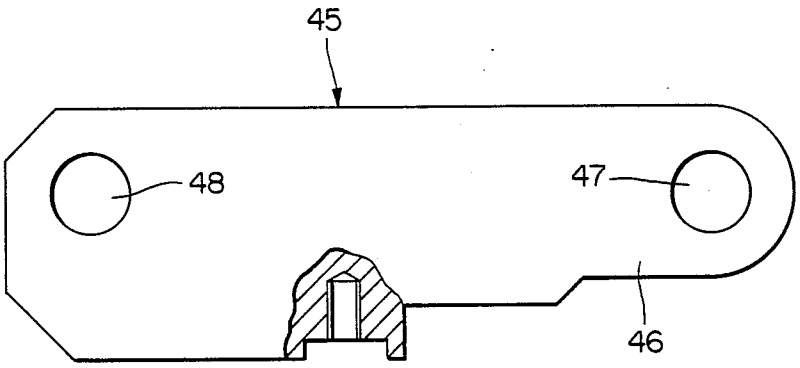
FIG. 18 is a side view of one of the four link rods supporting the pair of containers for springs used to push the removable and tilting frame upwards.
Figure 19:
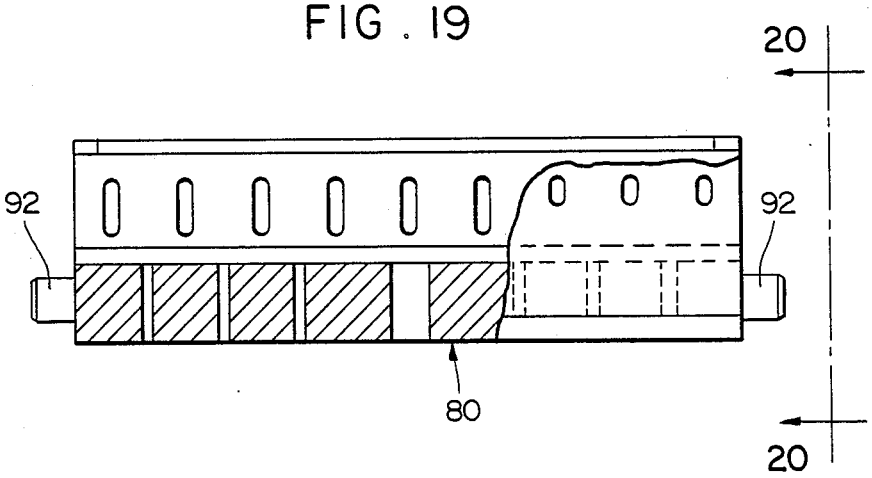
FIG. 19 is a side view of one of said two containers for springs, shown partly as a cross-section.

The upper end 46 of a link rod 45 (see FIG. 18), equipped with an upper hole 47 for this purpose, is jointed to the pin 44, between the vertical bracket 40 and the lug 126.

On its lower end this link rod 45 has a second hole 48, also called the link rod lower hole. The function of the link rod (45) is explained later; for the moment it is sufficient to say that the four lugs 126, the four vertical brackets 40 and the four pins 44 support four symmetrically arranged link rods 45.

A second hole 49, parallel to the first hole 43 passes through the vertical brackets 40 near their lower ends. This second hole 49 is capable of accommodating a pin 50 (see FIG. 2) which at the other end passes through a vertically elongated slot 32 prepared in a lug 31 protruding sideways from the removable frame 30.

Thus the second frame 30, also called the removable frame, is supported by four pins 50 protruding from the lower hole 49 of the brackets 40, through the slots 32 in the lugs 31.

Since these slots are elongated vertically, when the removable metal frame 30 is hanging from the pins 50 it is vertically mobile for a distance equal to the difference between the length of these slots and the diameter of the pin 50.

Furthermore, by removing a pair of pins 50, both on the same side of the metal frame 30, the removable frame 30 can be tilted on a vertical axis for the necessary maintenance operations. On the vertical edges of the removable frame 30 between the two pairs of slotted lugs 31, there are two upper flanges 33 protruding outwards, the function of which is described later.

The same removable frame 30 has a second pair of lower longitudinal flanges, that is to say located at a level lower than the first two, protruding inwards.

Figure 15:
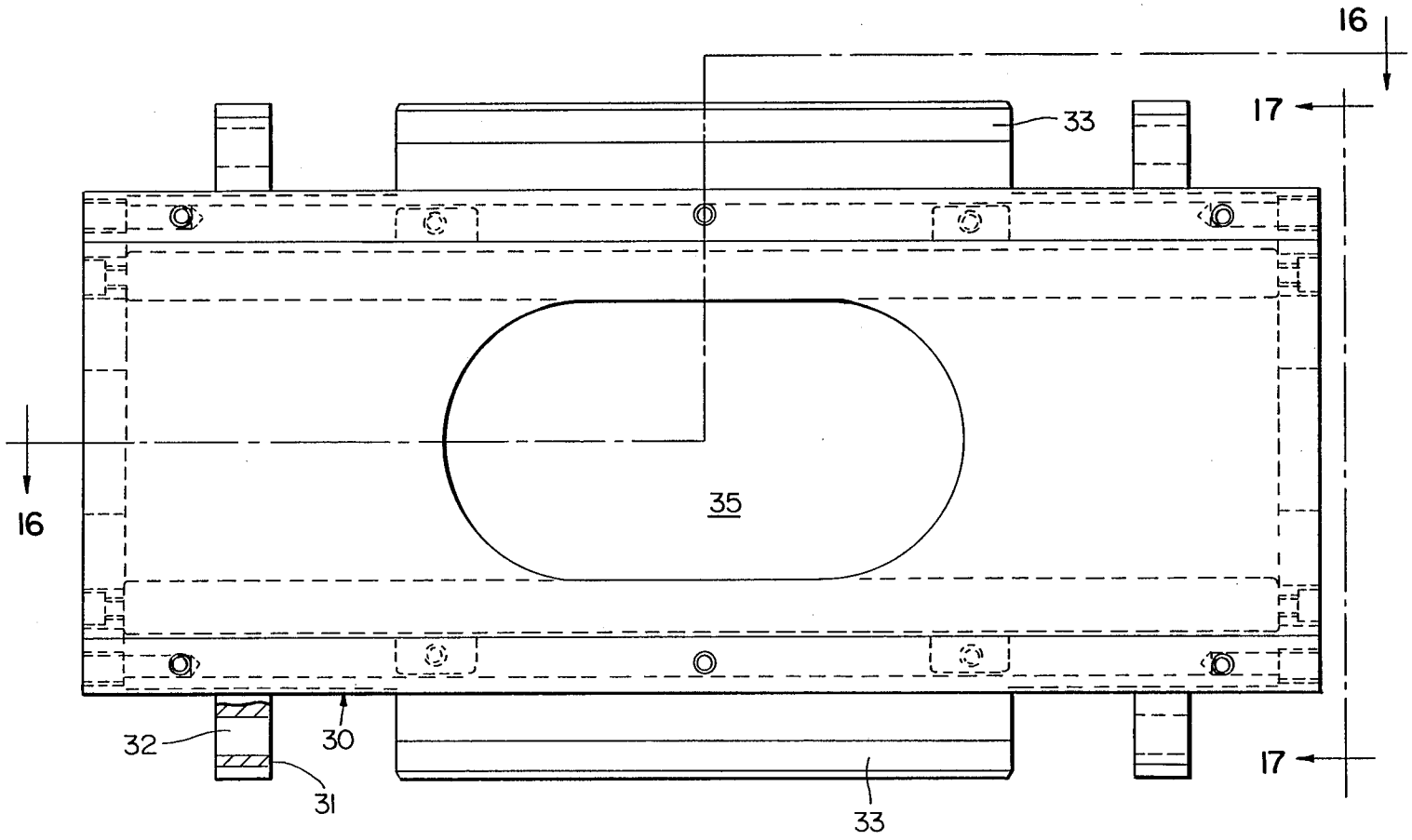
FIG. 15 is a view from below of the removable and tilting frame.
Figure 16:
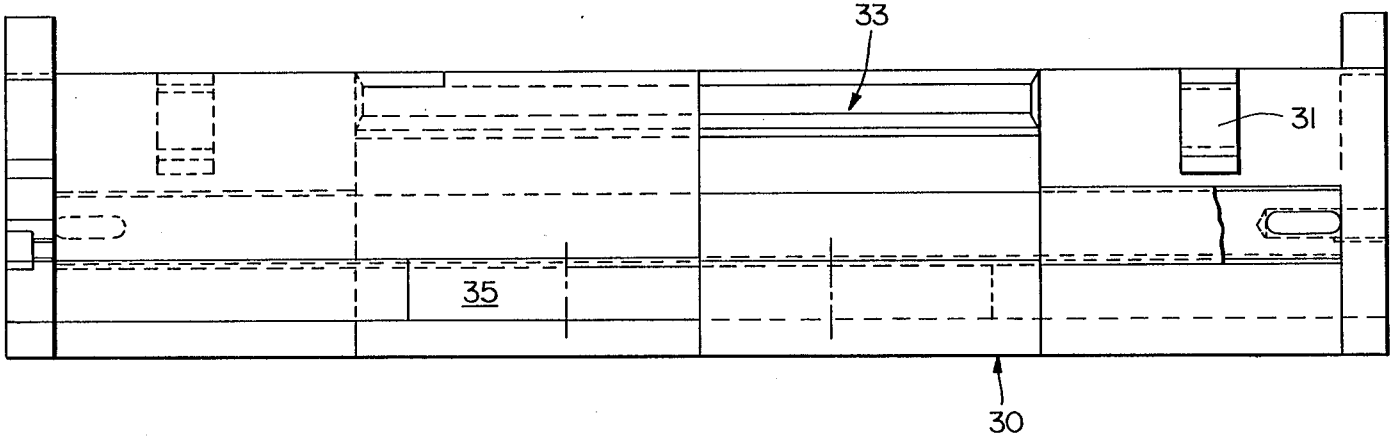
FIG. 16 is a side view of the same, partly shown as a cross-section on section plane XVI—XVI of FIG. 15.
Figure 17:
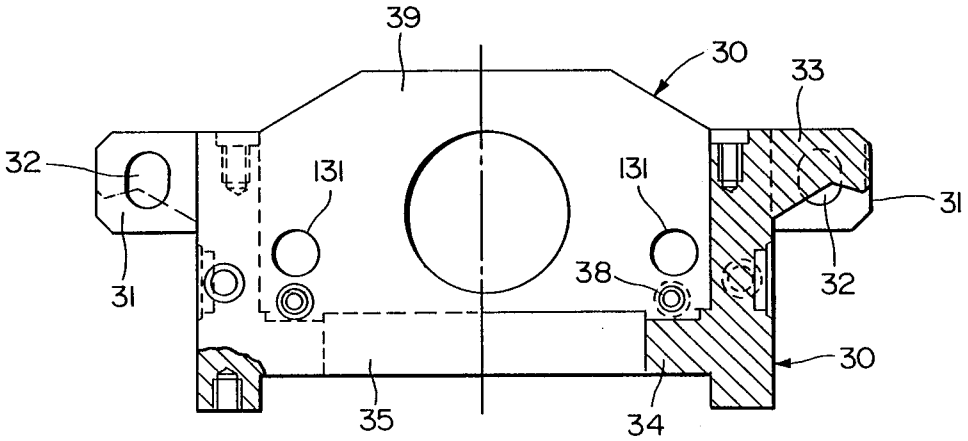
FIG. 17 is a front view of the removable and tilting frame, partly as a cross-section on section plate XVII—XVII of FIG. 15.

Furthermore, the removable frame 30 has a wide central opening, elongated, indicated by 35 (see FIG. 15). Two gibs 36 rest on the upper surface of the internal flanges 34 (see FIG. 1), with blind holes on their ends able to accommodate with some clearance the ends of the retaining screws 37 which pass through threaded holes 38 in the two ends 39 of the removable frame 30. In this way the gibs 36, which as shall be seen act as guides, are maintained in a correct position above the inside lower flanges 34, although they are free to expand due to the action of the temperature changes to which the device claimed here is subjected.

Above the threaded holes 38, in the two ends 39 of the removable frame 30, there are two more pairs of holes 131 which act as openings through which a tool suitable for acting on the retaining screws 132 of a pair of gibs 61 by means of which a sliding frame 60 rests on the gibs 36 of the removable frame 30.

The gibs 61 (see FIG. 1) are housed in longitudinal steps 62 prepared in the lower side edges of the sliding frame 60.

Figure 24:
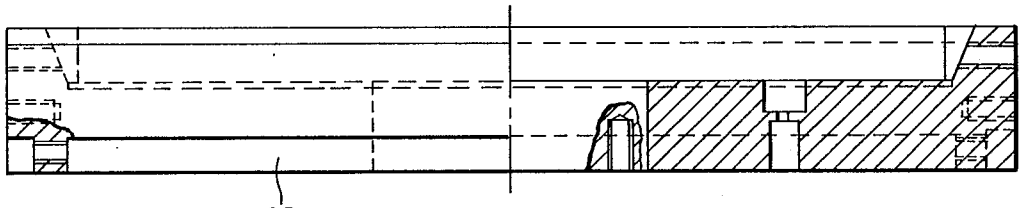
FIG. 24 is a side view of said frame, partly shown as a cross-section on plane XXIV—XXIV of FIG. 23.
Figure 23:
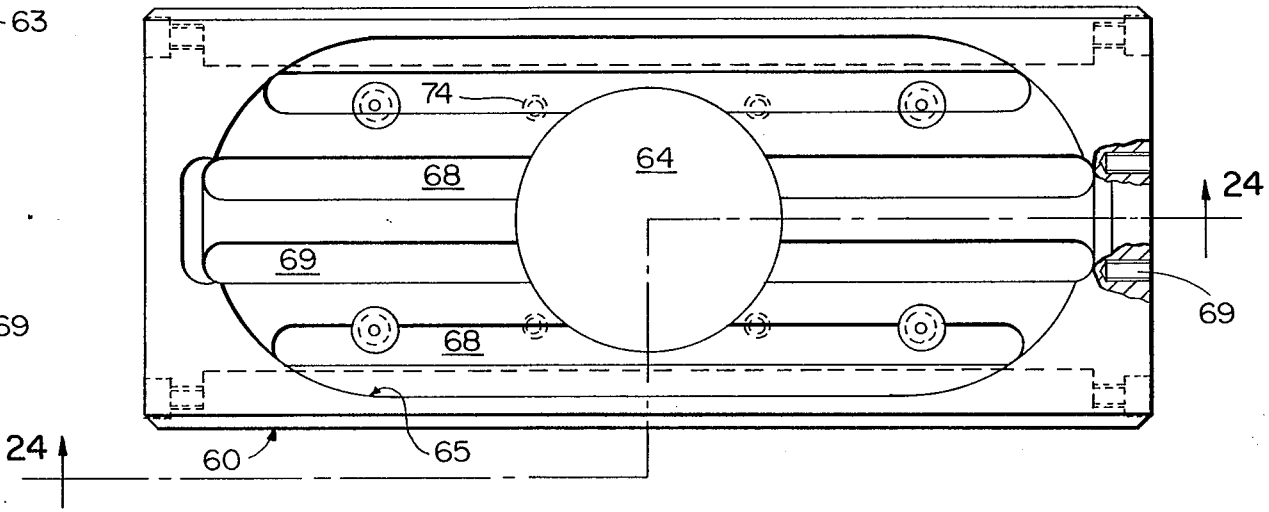
FIG. 23 is a top view of the sliding frame onto which the mobile refractory frame is fixed with the frame itself.
Figure 25:
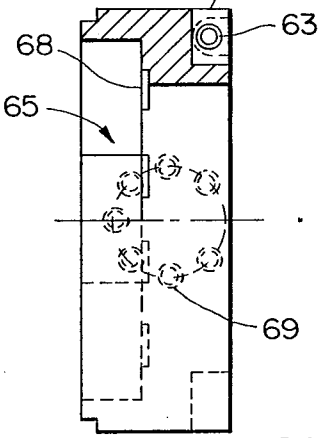
FIG. 25 is a front view of the sliding frame, partly shown as a cross-section on the dotted line XXV—XXV of FIG. 23.

The threaded holes 63 for housing the retaining screws 132 (FIG. 1) can be seen in FIGS. 23 to 25.

The sliding frame 60 has a central through hole 64 and, on its upper surface, an elongated impression 65 capable of accommodating a refractory plate 66 equipped with a central hole 67.

Suitable grooves 68 accommodate the mortar for securing the refractory plate 66 which slides on the metal frame 60.

On the two ends of the sliding frame 60 there are holes 69 for fixing a rod to control the longitudinal position of the sliding frame.

To make sure that the metal frame 60 moves in an absolutely straight line longitudinally, small guide plates 133 are fixed by means of screws 134 to the upper surface of the removable frame 30; the inner surface of these plates skims the sides of the sliding metal frame 60, ensuring the required relative movement in a straight line.

Figure 26:
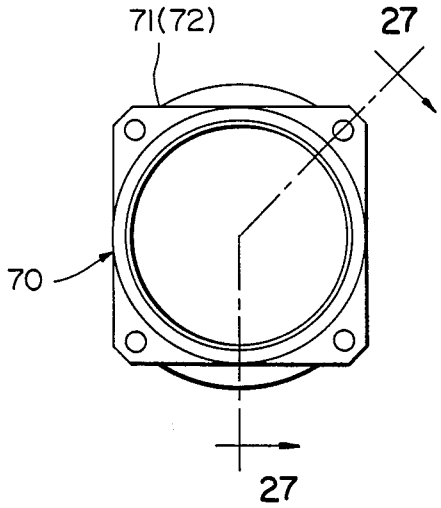
FIG. 26 is a top view of a supporting bell for a sleeve made of refractory material to be mounted under the sliding refractory plate.

The central hole 64 in the metal frame 60 is passed through by a slender metal sleeve 70 (see FIGS. 26 and 27) fitted with holed lugs which protrude radially outwards 71 and 72, located on two levels; the upper lugs, 71, are applied to the lower surface of the sliding metal frame 60 by means of screws 73 which screw into threaded holes 74; the lower lugs support a first metal plate 75 which acts as a heat shield, and which is obviously mobile in respect of the sliding frame 60, by means of screws 76.

Figure 27:
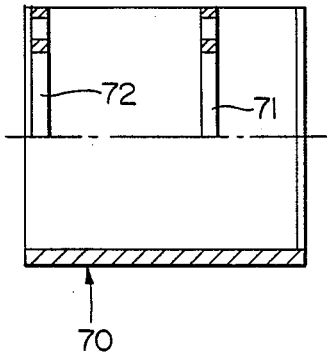
FIG. 27 is a side view, shown half as a cross-section, of the same sleeve.

As shown in FIG. 1 and FIG. 27, the inner surface of the metal sleeve 70 is tapered inwards and downwards so as to provide a conical resting surface for the corresponding outer surface of a second refractory sleeve 77 or, as in the case shown in the figure, for the outer surface of its metal casing.

The upper edge of the sleeve 77 rests against the bottom surface of the sliding refractory plate 66 by means of a suitable key.

Based on the above description, it is clear that the fixed frame 20 is secured to the lower surface of the flattening ring 11 by means of the screws 21. The fixed refractory plate 17 is supported against the lower surface of the metal frame 20 by means of a thin layer of refractory mortar and by means of retaining bridges 29. The vertical brackets 40 protruding downwards from the sides of the fixed frame 20 in turn support the removable frame 30 by means of pins 50 which pass through the slots 32.

In turn the removable metal frame 30 supports the sliding frame 60 and the upper refractory plate 66 above it by the pairs of gibs 61 and 36.

In this position, however, due to the presence of the vertically elongated slots 32, the upper surface of the sliding refractory plate 66 is not in contact with the lower surface of the fixed refractory plate 17; it is a question of pressing said two refractory plates one against the other with an evenly distributed load.

For this purpose, according to the invention there are two containers for springs 80, elongated, with a U-shaped transverse cross-section; they therefore have a solid bottom 81 and sides 82, the upper edge of which are fitted with inner flanges 83.

The sides 82 are also equipped with cooling openings 84.

Using a special tool, a series of packs of springs 87, preferably cup springs, mounted on parallel vertical pins 88 protruding downwards from an elongated prod 89 is inserted into the groove 86 defined by the solid bottom 81 and by the sides 82.

The elongated prod 89 is fitted with side flanges 90 which hit against the lower surfaces of the inner flanges 83 of the casing 80, due to the action of the springs 87.

A transverse pin 91, mobile with clearance in a suitable pair of vertically slotted cavities in the sides of the casing 80 ensures axial locking of the prod 89 in the groove 86.

Two pins 92 suitable for being housed in the lower holes 48 of the link rods 45 protrude from the two ends of the casing 80; the two casings 80 can therefore oscillate around the axis of said pins.

It should be noted that the upper outer flanges 33 of the removable frame 30 are fitted with a very open V shaped groove 135 in which the end of the elongated prod 89 will fit.

Figure 28:
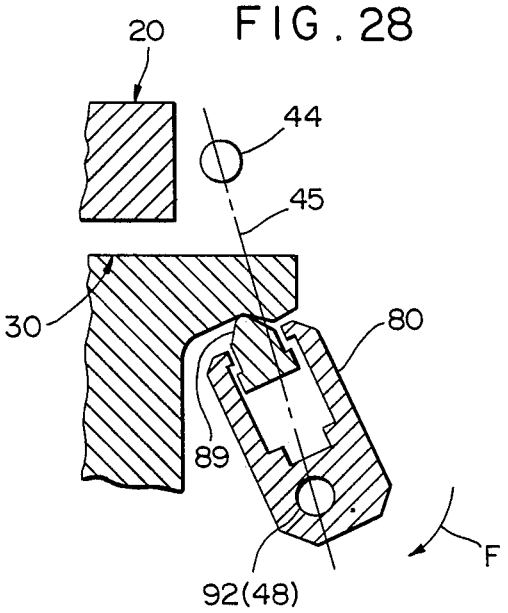
FIG. 28 shows schematically the relative positions of the fixed and removable frames, of the link rods and of the container for the springs, in the position in which the removable frame has not yet been pushed against the fixed frame above it.

The position of the link rods 45 and of the casings for the springs 80 when the removable frame 30 comes to rest on the pins 50 by means of the slots 32 in the lugs 31 is schematically illustrated in FIG. 28. The axis of the link rods 45 is external to that of the casing 80 and above all it is external to the line of application of the prod 89 on the throat of the lower V shaped groove, 135, on the underside of the upper outer flanges 33 of the removable metal frame 30.

Figure 29:
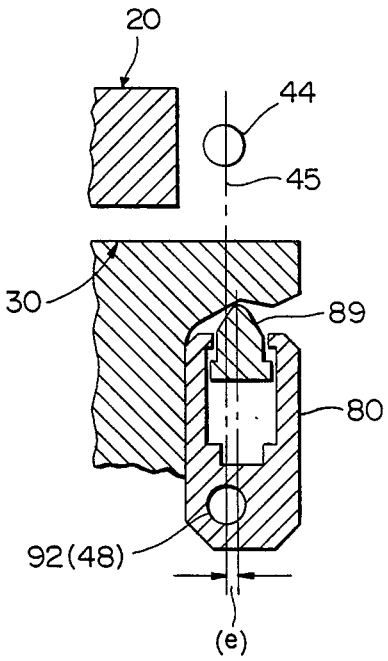
FIG. 29 shows schematically the relative positions of the fixed and removable frames, of the link rods and of the container for the springs, in the position occupied by the removable frame and by the remaining mobile elements after said removable frame has been pushed against the fixed frame above it.

If the casing 80 is made to rotate inwards using a special tool, in the direction of the arrow F in FIG. 28, the springs will undergo a maximum compression after which, if rotation is continued through a suitable angle, however small, the springs will extend partially after the axis of the link rod 45 has passed the line of application of the prod 89, as shown schematically in FIG. 29.

The removable frame 30 will thus be pressed elastically against the fixed frame 20 as shown in FIG. 1: in particular the mobile refractory plate will be pressed against the fixed refractory plate.

Obviously, in order to achieve a similar stable position it is necessary for there to be a suitable eccentricity (e) between the axis of the pins 92 and the plane on which the axes of the spring packs of the casing 80 lie, as shown in FIG. 20.

The reverse operation will be required to loosen the removable frame 30.

It is worthwhile to point out here how the springs of the various packs all work in the same conditions, far away from the direct source of heat and in any case they are cooled by jets of air through the slits 83 and 84.

The degree of compression of the various springs is exactly equal, within small limits, thanks to the fact that the springs work between high-precision tool-machined metal surfaces.

Replacement of the springs is extremely easy since it is possible in a single operation to replace all the springs of either of the two containers, preassembled inside the container itself.

It will therefore be sufficient to include in the equipment pertaining to the pouring appliance a prod and a spare container on which to replace all the springs for one side of the removable frame.

Replacement of the springs can therefore take place while the slide-gate pouring device is in use, and therefore without losing time.

What I claim is:

1. Slide-gate pouring device comprising:

a first metal frame, solid with the bottom of a ladle, and supporting a first fixed holed refractory plate, a second removable metal frame, hanging with a clearance from said first metal frame and supporting a pair of fixed guides on which, through complementary guides there runs a third sliding metal frame supporting a second holed refractory plate, between a first working position in which the hole in the first fixed refractory plate is aligned with the hole in the second holed refractory plate, and a second working position in which the holes in said first fixed and said second refractory plates are out of axis and do not interfere with each other, in which said slide-gate pouring appliance has tightening means capable of pressing said second holed and said first fixed hole refractory plates against one another and maintaining contact between them, on each side of said second removable metal frame a container for springs is jointed to a lower end of a pair of link rods, upper ends of which are jointed to said first metal frame, and in which said springs apply a prod against an outer flange on said second removable metal frame and in which the axis of action of the springs is outside a straight line joining centres of pins articulating said link rods.

2. Slide-gate pouring appliance according to claim 1, wherein said container for springs has a U-shaped transverse cross-section, open towards the top, parallel arms of which end in flanges which are hit by corresponding external flanges provided on the prod pushed outwards by said springs.

3. Slide-gate pouring appliance according to claim 1, wherein said container for springs contains a series of spring packs, precompressed between a bottom of the container and a single prod from which a series of centering pins protrude downwards for each of said packs of springs.

4. Slide-gate pouring appliance according to claim 1, wherein two outer flanges of the second removable metal frame, against which said prod rests is equipped with a wide V shaped groove which ensures centering of said prod.

5. Slide-gate pouring appliance according to claim 3, wherein each of said pins has an annular groove for a retaining ring against which a ring nut supporting the pack of springs rests, while at another end of the spring pack, the spring pack rests on a bottom of said prod.

6. Slide-gate pouring appliance according to claim 4, wherein said prod has an essentially pentagonal transverse cross-section, symmetrical to an axis of action of the springs, a base of which extends sideways to create said two flanges.

7. Slide-gate pouring appliance according to claim 1, wherein said first metal frame has on its lower surface a wide longitudinal groove with a ridged bottom; in which on the inside surfaces of the sides of said groove there are two opposing pairs of impressions capable of accommodating the ends of two longitudinal retaining bridge for the first fixed hole refractory plate which is to fit inside said groove.

8. Slide-gate pouring appliance according to claim 7, wherein said first metal frame has on its longitudinal sides two pairs of opposing impressions capable of accommodating two pairs of vertical brackets protruding downwards; in which connection of these brackets with the first metal frame is ensured by means of screws and in which each of these vertical brackets has a pair of holes parallel at different heights: a first hole of said pair of holes is capable of accommodating an upper pin of articulation of said link rods, while a second hole of said pair of holes is capable of accommodating a supporting pin for the second removable metal frame through vertically slotted holes made in lugs which protrude from said second removable metal frame.

9. Slide-gate pouring appliance according to claim 8, wherein upper pins of articulation of said link rods are each supported by an upper hole in the vertical brackets on one side, and by a hole, aligned with the previous one, made in lugs protruding sideways from the first metal frame.

10. Slide-gate pouring appliance according to claim 7, wherein said first metal frame has a circular hole inside having a circular ring for centering a lower end of a fixed refractory sleeve which comes to rest on the first fixed hole refractory plate; said centering ring has lugs protruding radially outwards for securing to the bottom of the first metal frame.

11. Slide-gate pouring appliance according to claim 10, wherein said centering ring has depressions which make it easier to insert a tip of a demolition tool when replacing the refractory sleeve above the first fixed hole refractory plate.

12. Slide-gate pouring appliance according to claim 7, wherein said retaining bridges are in contact with an underside of the first metal frame only on their ends, to allow remains of the first fixed hole refractory plate to pass when this is demolished for replacement purposes.

13. Slide-gate pouring appliance according to claim 1, wherein the third sliding metal frame rests on top of the second removable metal frame by means of two pairs of gibs installed on a pair of inner flanges of the second removable frame on one side and on two side grooves in the bottom of the third sliding frame on the other side.

14. Slide-gate pouring appliance according to claim 13, wherein each of these gibs has longitudinal blind holes on its two ends; in which tips of screws screwed respectively to the third sliding metal frame and to the second removable metal frame protrude with some clearance into said blind holes.

15. Slide-gate pouring device according to claim 1, wherein the third sliding metal frame is guided in its movement by lateral guides located on the second removable metal frame.

* * * * *